US006880266B2

(12) United States Patent
Schoenborn et al.

(10) Patent No.: US 6,880,266 B2
(45) Date of Patent: Apr. 19, 2005

(54) FOOTWEAR SOLE

(75) Inventors: Mary L. Schoenborn, Rockford, MI (US); Raymond M. Fredericksen, Haslett, MI (US)

(73) Assignee: Wolverine World Wide, Inc., Rockford, MI (US)

( * ) Notice: Subject to any disclaimer, the term of this patent is extended or adjusted under 35 U.S.C. 154(b) by 0 days.

(21) Appl. No.: 10/410,046

(22) Filed: Apr. 9, 2003

(65) Prior Publication Data

US 2003/0192202 A1 Oct. 16, 2003

Related U.S. Application Data

(60) Provisional application No. 60/371,315, filed on Apr. 10, 2002.

(51) Int. Cl.[7] ..... B43B 13/18

(52) U.S. Cl. ..... 36/28; 36/30 R

(58) Field of Search ..... 36/28, 29, 31, 36/44, 30 R

(56) References Cited

U.S. PATENT DOCUMENTS

| | | | |
|---|---|---|---|
| 2,097,759 A | 11/1937 | Ehrlich | |
| 2,266,369 A | 12/1941 | Kohn | |
| 2,790,254 A | 4/1957 | Burns | |
| 2,857,689 A | 10/1958 | Ostrom et al. | |
| 3,081,774 A | 3/1963 | Lelyveld | |
| 3,903,621 A | 9/1975 | Dubner | |
| 3,985,853 A | 10/1976 | Weisberg | |
| 4,137,654 A | 2/1979 | Hlavac | |
| 4,180,924 A | 1/1980 | Subotnick | |
| 4,219,945 A | 9/1980 | Rudy | |
| 4,232,457 A | 11/1980 | Mosher | |
| 4,235,028 A | 11/1980 | Riggs | |
| 4,268,980 A | 5/1981 | Gudas | |
| 4,302,892 A | 12/1981 | Adamik | |
| 4,320,588 A | 3/1982 | Sottolana | |
| 4,333,472 A | 6/1982 | Tager | |
| 4,364,188 A | 12/1982 | Turner et al. | |
| 4,364,189 A | 12/1982 | Bates | |
| 4,446,633 A | 5/1984 | Scheinhaus et al. | |
| 4,547,979 A | 10/1985 | Harada et al. | |
| 4,557,060 A | * 12/1985 | Kawashima | 36/44 |
| 4,597,195 A | 7/1986 | Dananberg | |
| 4,615,126 A | 10/1986 | Mathews | |
| 4,620,376 A | 11/1986 | Talarico, II | |
| 4,627,177 A | 12/1986 | Meyers | |

(Continued)

FOREIGN PATENT DOCUMENTS

| | | |
|---|---|---|
| DE | 27 09 546 A | 9/1978 |
| DE | 90 13 727 | 12/1990 |
| DE | 43 33 597 A | 4/1994 |
| EP | 0 257 497 A | 3/1988 |
| FR | 2 553 636 A | 4/1985 |
| WO | WO 9423604 | 10/1994 |
| WO | WO 11573 A | 2/2002 |

*Primary Examiner*—Ted Kavanaugh
(74) *Attorney, Agent, or Firm*—Warner Norcross & Judd

(57) ABSTRACT

A sole component for an article of women's footwear intended to address biomechanical characteristics unique to women. The sole component includes a lateral alignment portion underlying and extending through a region beneath the distal head of the second metatarsal, the distal head of the fifth metatarsal and the proximal head of the fifth metatarsal, and not into the flex zone ahead of the distal heads of metatarsals. The lateral alignment portion provides relatively firm resistance to compression. The sole component may further include a forefoot fixing portion underlying the distal head of the fifth metatarsal. The forefoot fixing portion provides relatively soft resistance to compression. In some embodiments, the sole component may also include a medial alignment portion extending along the medial side of the component from the heel through the arch.

23 Claims, 11 Drawing Sheets

U.S. PATENT DOCUMENTS 4,642,911 A 2/1987 Talarico, II
4,689,898 A 9/1987 Fahey
4,702,255 A 10/1987 Schenkl
4,730,402 A * 3/1988 Norton et al. ..... 36/30 R
4,747,410 A 5/1988 Cohen
4,759,136 A 7/1988 Stewart et al.
4,766,679 A * 8/1988 Bender ..... 36/30 R
4,821,430 A 4/1989 Flemming et al.
4,890,397 A 1/1990 Harada et al.
4,910,886 A 3/1990 Sullivan et al.
4,918,841 A 4/1990 Turner et al.
4,984,376 A 1/1991 Walter et al.
5,014,706 A * 5/1991 Philipp ..... 36/140
5,042,174 A 8/1991 Nichols
5,046,267 A 9/1991 Kilgore et al.
5,056,535 A 10/1991 Bonnell
5,077,915 A 1/1992 Gross
5,170,776 A 12/1992 Pecheux
5,174,052 A 12/1992 Schoenhaus et al.
5,197,207 A 3/1993 Shorten
5,220,737 A 6/1993 Edington
5,224,279 A 7/1993 Agnew
5,247,742 A 9/1993 Kilgore et al.
5,280,680 A 1/1994 Burke et al.
5,317,819 A 6/1994 Ellis, III
5,327,663 A 7/1994 Pryce
5,353,523 A 10/1994 Kilgore et al.
5,448,839 A 9/1995 Blissett et al.
5,493,791 A 2/1996 Kramer
5,542,196 A * 8/1996 Kantro ..... 36/44
5,611,153 A 3/1997 Fisher et al.
5,632,104 A 5/1997 Zohar
5,642,575 A 7/1997 Norton et al.
5,678,329 A 10/1997 Griffin et al.
5,718,063 A 2/1998 Yamashita et al.
5,724,753 A 3/1998 Throneburg et al.
5,771,606 A 6/1998 Litchfield et al.
5,787,610 A 8/1998 Brooks
5,852,887 A 12/1998 Healy et al.
5,878,510 A 3/1999 Schoesler
5,964,046 A 10/1999 Brooks
6,026,599 A * 2/2000 Blackwell et al. ..... 36/140
6,108,943 A 8/2000 Hudson et al.
6,115,941 A 9/2000 Ellis, III
6,131,311 A * 10/2000 Brown et al. ..... 36/43
6,199,303 B1 3/2001 Luthi et al.
6,253,469 B1 * 7/2001 Atlani et al. ..... 36/174
6,308,439 B1 10/2001 Ellis, III
6,314,662 B1 11/2001 Ellis, III
6,360,453 B1 3/2002 Ellis, III
6,401,366 B1 6/2002 Foxen et al.
6,618,960 B1 * 9/2003 Brown ..... 36/44
2002/0050078 A1 5/2002 Dietrich et al.

* cited by examiner

FOOTWEAR SOLE

This application claims the benefit of U.S. Provisional Application Ser. No. 60/371,315, entitled SHOE SUPPORT STRUCTURES, PARTICULARLY FOR WOMEN, filed Apr. 10, 2002, which is incorporated herein by reference in its entirety.

BACKGROUND OF THE INVENTION

The present invention relates to footwear, and more particularly to a sole construction for an article of footwear.

Running shoes, as well as other footwear, have undergone tremendous evolutionary advances in technology over the past 20 years. Many of the technological advances have occurred in the midsole and are the result of knowledge gained from biomechanical studies of human motion. In most footwear, the midsole functions as the suspension system of the sole and it often provides both protective cushioning and a stable platform for the wearer's foot. Many conventional technologies have focused on cushioning the impact associated with foot strike by varying the spring coefficients in the midsole to disperse shock. Relatively recent research has also provided significant clinical guidance in understanding how the complex motions of the foot affect human motion. As a result of that research, many conventional running shoes incorporate some type of stability device in the sole to help provide support to the intricate architecture of the foot. These biomechanical studies and related technological improvements have focused primarily on males, largely ignoring the biomechanical differences between men and women. Accordingly, most conventional biomechanically-designed footwear technology is tailored to address the biomechanical characteristics of a man.

As a result, studies show that women tend to suffer a disproportionate number of certain walking and running related injuries. For example, studies show that women have a higher incident of injury to the anterior cruciate ligament of the knee. It is believed by many that this is at least in part a result of the unique biomechanical characteristics of women. In many cases, these injuries are addressed by a podiatrist or an orthopedist, who may prepare custom orthotics that are designed to be fitted into the woman's shoes. These orthotics commonly address specific foot abnormalities by varying the shape of the foot using wedges, posts and other similar elements. The precise characteristics of the orthotic insert for a given person will vary based on the specific characteristics of that person's foot and the related injury. Although conventional wedges, posts and other similar elements may relieve pain and reduce the likelihood of repetitive injury for a person, they do so by reshaping the foot to address the specific abnormalities of that person's foot. Conventional orthotics do not properly address the issues raised by underlying differences in the body motion of women. In fact, podiatrists and orthopedists typically analyze the foot while it is not in a load bearing situation, crafting orthotics or other inserts based on the profile of unloaded feet as well as input from the patient. Further, conventional orthotic inserts are relatively expensive, requiring a person to engage an orthopedist or podiatrist. Additionally, orthotics and other conventional inserts are placed into the upper of a shoe. By occupying space intended for the foot, these inserts may have a negative impact on the fit and feel of the shoe. Orthotics are also unlikely to alleviate the problem of premature sole breakdown.

SUMMARY OF THE INVENTION

The aforementioned problems are overcome by the present invention which provides a sole designed specifically to accommodate a woman's gait pattern. The midsole defines a foot platform that includes a neutral portion forming a majority of the foot platform and a lateral alignment portion disposed on the lateral side of the sole in the forefoot region. The lateral alignment portion is formed from a firmer material than the neutral portion. In one embodiment, the lateral alignment portion is configured to extend generally from the proximal head of the fifth metatarsal to the distal head of the fifth metatarsal and from the distal head of the fifth metatarsal region to the distal head of the second metatarsal.

In some applications, the midsole may further include a forefoot fixing portion disposed beneath the head of the fifth metatarsal within the boundaries of the lateral alignment portion. The forefoot fixing portion is manufactured from a softer material than the surrounding lateral alignment portion, and possibly also softer than the neutral portion, to aid in aligning the foot on the sole and provide cushioning to the fifth metatarsal head, which has been determined to be a peak pressure zone for women.

In yet another embodiment, the midsole further includes a medial alignment portion that extends from a point near the back of the heel through the arch region. The medial alignment portion is manufactured from a firmer material than the neutral region, and possibly of the same firmness as the lateral alignment portion.

The present invention provides a unique footwear sole that is specially configured to correspond with a woman's gait pattern. Unlike conventional footwear, the present invention is configured to address the biomechanical differences between men and women. Among other things, the footwear sole affects the motion, and more specifically, the angular motion of the foot to facilitate alignment of the leg and reduce the rate of migration of the woman's center of mass during each stride. The footwear sole helps to provide a woman with a more fluid and balanced stride. In doing so, the sole provides improved comfort and stability for a woman, and may reduce or eliminate the discomfort that can result when wearing conventional footwear that is not configured to match with the unique gait pattern of women. As a result of these benefits, the present invention may also extend the wear-life of the shoe by reinforcing those regions where sole break-down or deterioration is most likely to occur.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 1B:
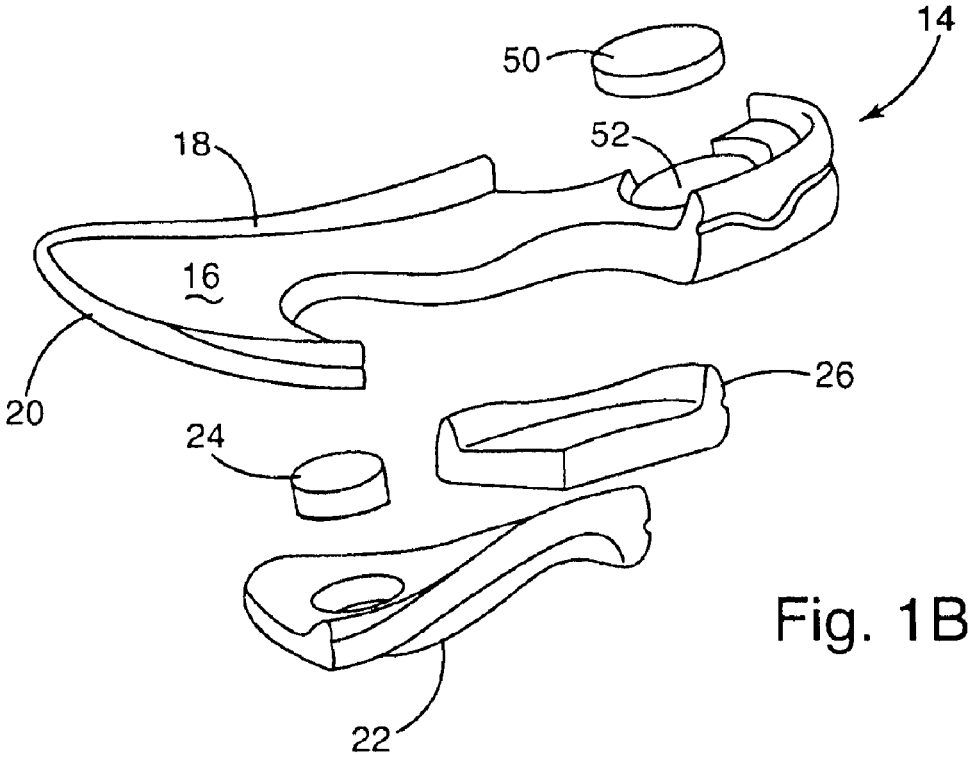
FIG. 1*b* is an exploded perspective view of the midsole of FIG. 1*a;*
Figure 1A:
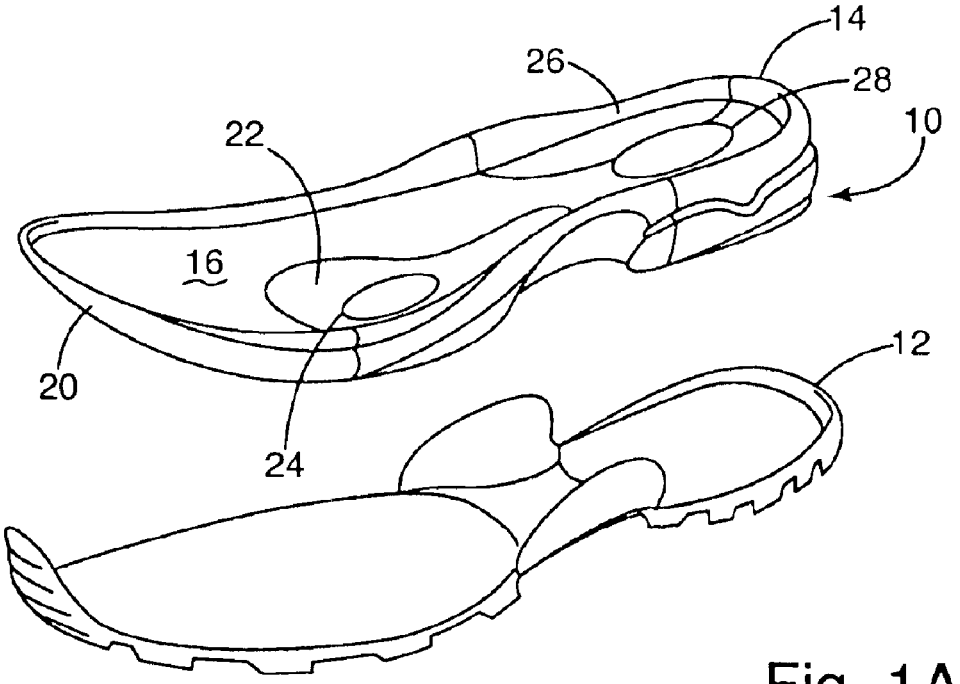
FIG. 1*a* is a partially exploded perspective view of a sole in accordance with a preferred embodiment of the present invention.

A footwear sole manufactured in accordance with a preferred embodiment of the present invention is shown in FIGS. 1*a–b*, and generally designated 10. The footwear sole 10 of the present invention is designed to meet needs specific to a woman's gait pattern and is intended specifically for use in women's footwear. In general, the footwear sole 10 includes portions of varying resistance to compression, wherein the size, shape, location and other characteristics of these portions are selected to address biomechanical issues unique to the way in which a woman moves through her stride. In the embodiment of FIGS. 1*a–b*, the footwear sole 10 includes an outsole 12 for engaging the ground and a midsole 14 having different portions that provide different cushioning properties. More specifically, the midsole 14 of the illustrated embodiment includes a neutral portion 14 that forms the majority of the foot platform. The midsole 14 also includes a lateral alignment region 16 disposed on the lateral side of the forefoot portion of the sole 10. The lateral alignment portion 16 is manufactured from a material that is firmer than the neutral portion 14.

I. Biomechanical Research

Recent biomechanical studies have shown that a woman's gait pattern differs dramatically from that of a man. These differences are largely the result of physical differences in the anatomy of men and women. Perhaps the most dramatic and important difference in terms of gait pattern is the relative pelvic girdle width between men and women. Women generally have a broader pelvis than men. As a result, women typically have a greater angulation from the hip down to the knee, often referred to as the Quadriceps angle, or Q-angle. The degree of angulation of the thigh bone is further increased by the fact that women are generally shorter than men. These factors contribute to provide women with a lower center of gravity.

Pressure profiles describe the topographical pattern of forces under the foot during human movement. The profiles describe the orientation of impact forces and how they are attenuated through the natural biomechanism of the human body. They also describe and locate peak concentrations of pressure that may contribute to over load injuries to the connective tissue of the human body, such as muscles, ligaments, tendons and bone. Pressure profiles provide a detailed "foot mapping" that is related to how the center of gravity is balanced and how efficiently it is aligned over the foot during human motion.

Figure 2:
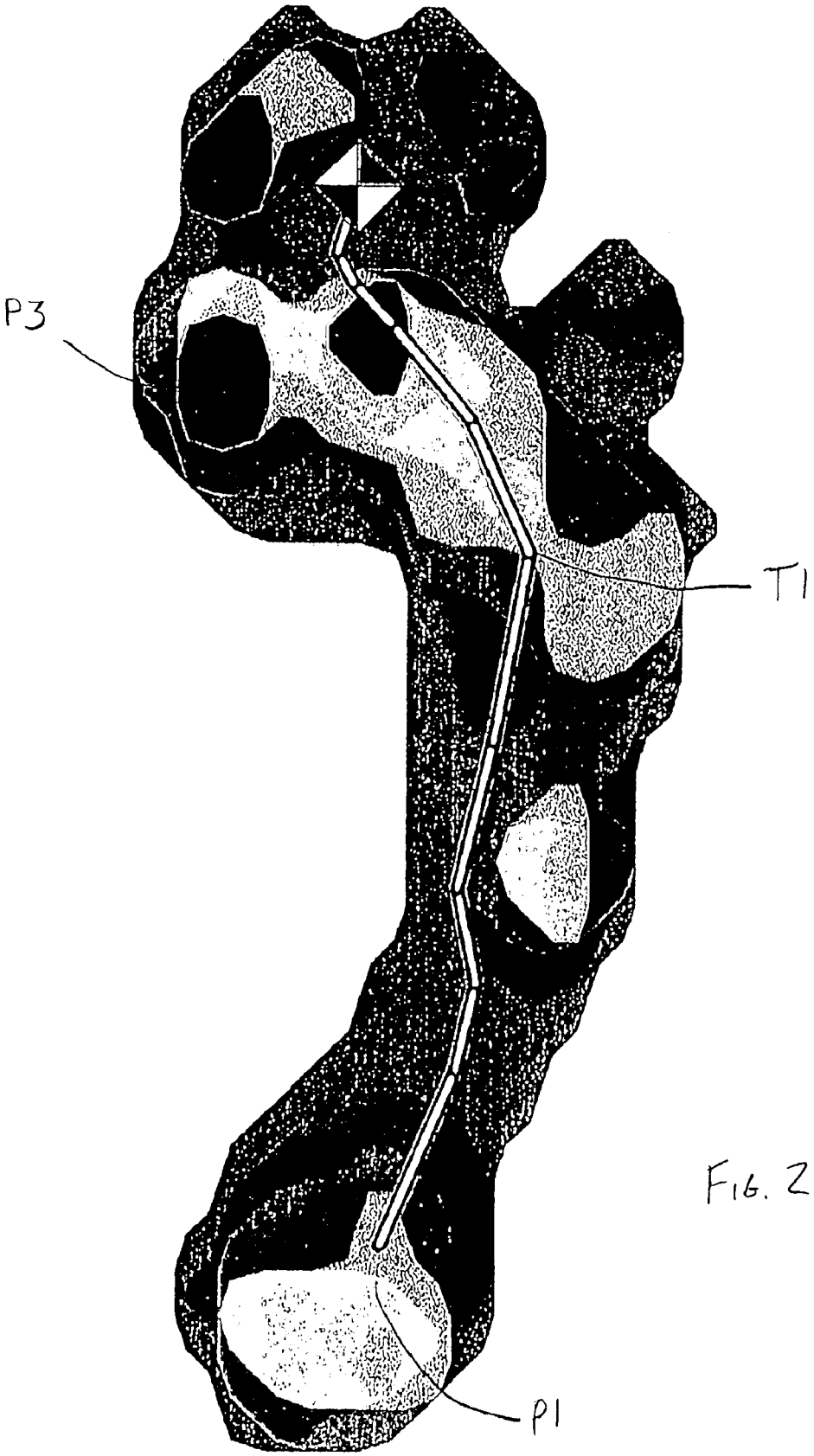
FIG. 2 is a male pressure profile.
Figure 3:
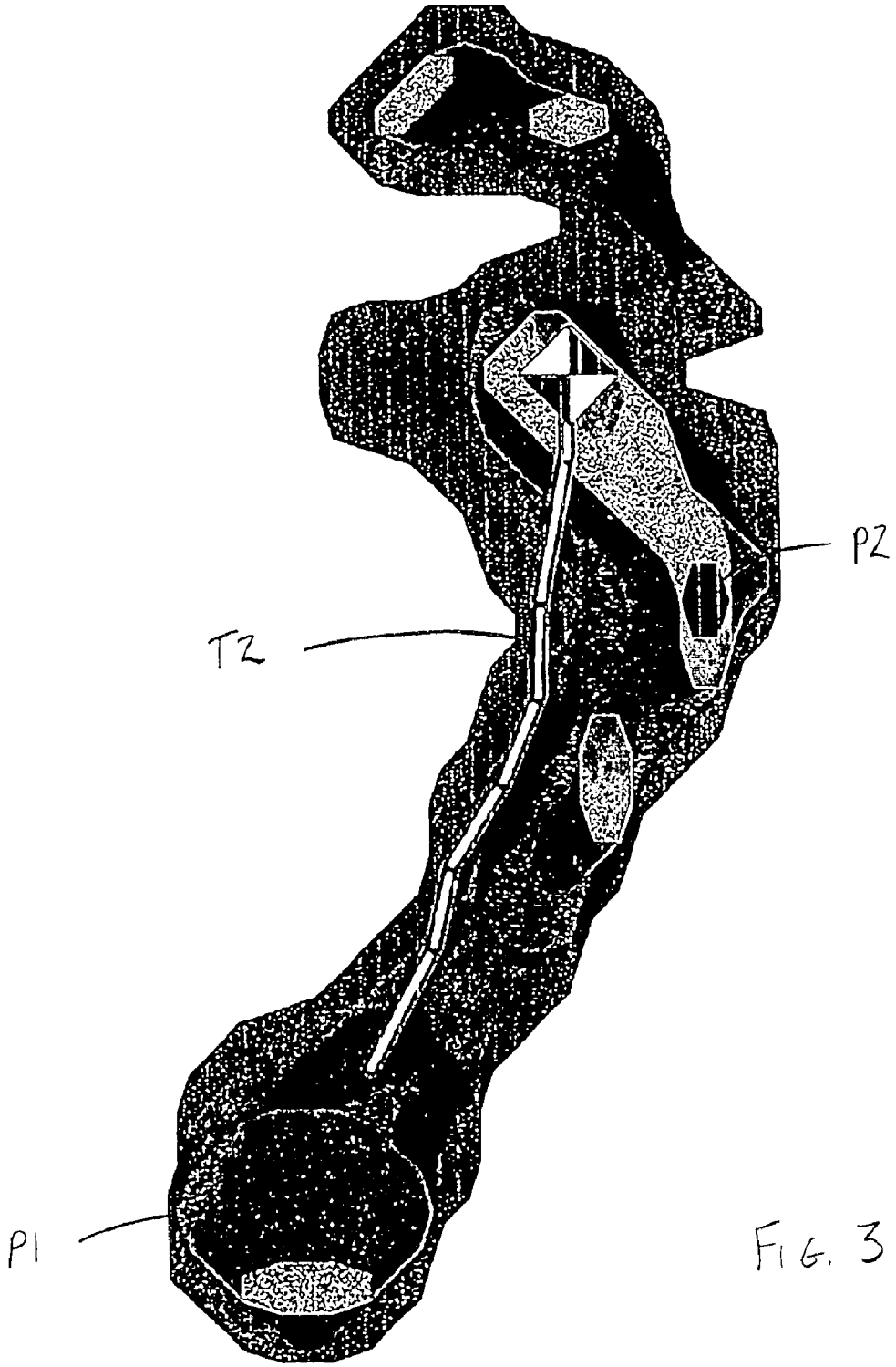
FIG. 3 is a female pressure profile.

The foot pressure profiles of women are significantly different than men because of their biomechanical differences. FIG. 2 shows a typical pressure profile for a man. FIG. 3 shows a typical pressure profile for a woman. As shown, both men and women exhibit a peak pressure zone P1 under the heel bone, or calcaneus, at foot strike. Women and men differ, however, in the way they compensate for the impact forces as they propel themselves into the next step. Women will typically exhibit another peak pressure zone P2 under the fifth metatarsal bone of the foot and along the lateral border of the foot. Men will typically exhibit a medial peak pressure zone P3 underneath the first metatarsal and big toe, or hallux. These pressure profiles also show traces T1 and T2 of the movement of the individuals' center of mass during the stride. As can be seen, these traces differ significantly between the male and female profiles. The difference between the pressure profiles is due to the anatomical structural differences between men and women. As noted above, the Q-angle of a woman is greater than that of a man. A greater Q-angle results in greater stress at the medial knee joint. To compensate for this misalignment, women will typically shift their center of gravity laterally. By shifting their weight to the outside, women naturally bring the leg into straighter alignment. This movement creates a peak pressure zone under the fifth metatarsal head and along the lateral border of the foot. This pressure pattern is a normal trend observed in a woman's gait pattern, but is not addressed in conventional shoe designs.

Figure 7A:
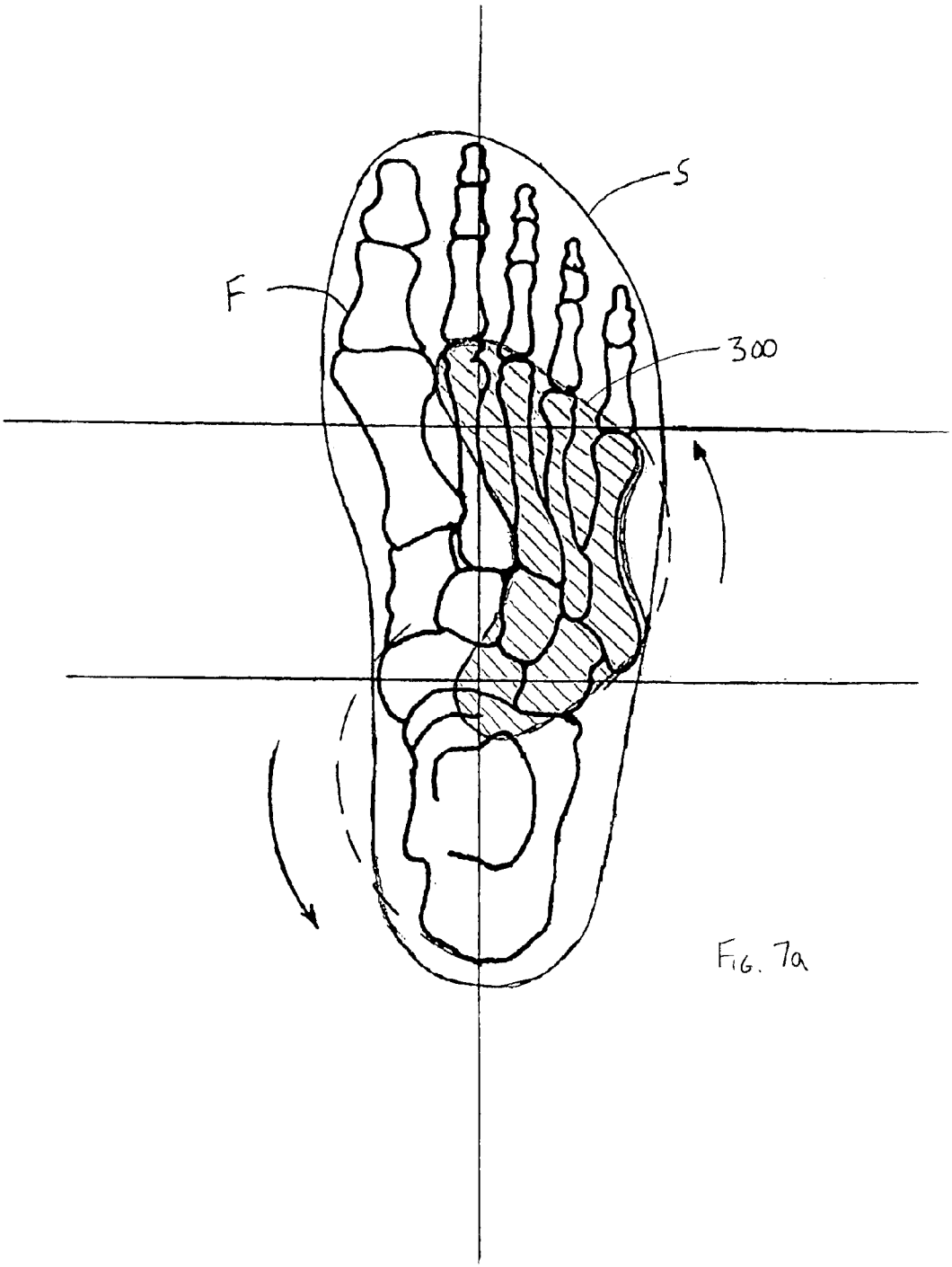
FIG. 7*a* is an illustration of a human foot showing the outline of a sole and an alternative lateral alignment portion.
Figure 7B:
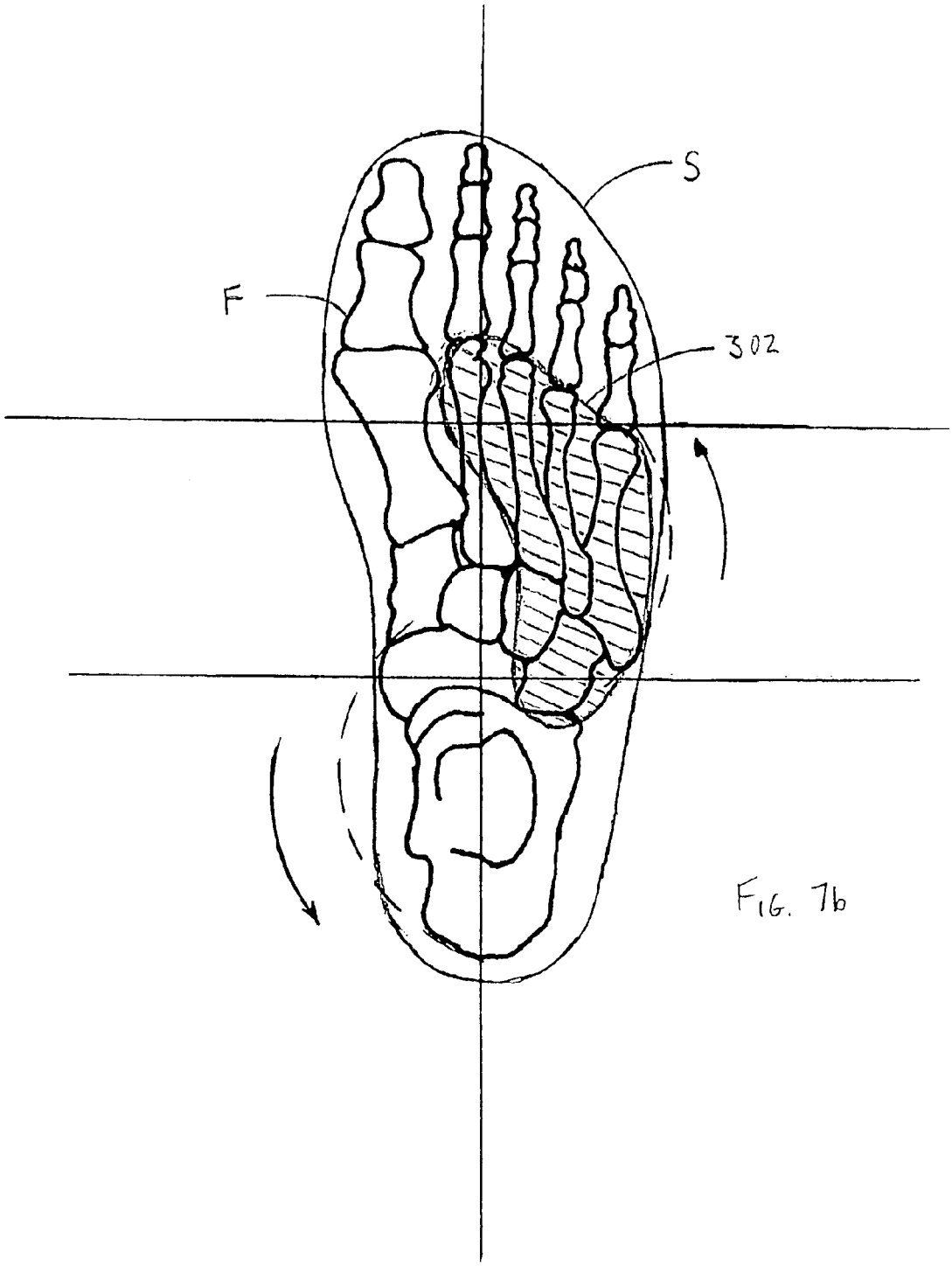
FIG. 7*b* is an illustration of a human foot showing the outline of a sole and a second alternative lateral alignment portion.
Figure 7C:
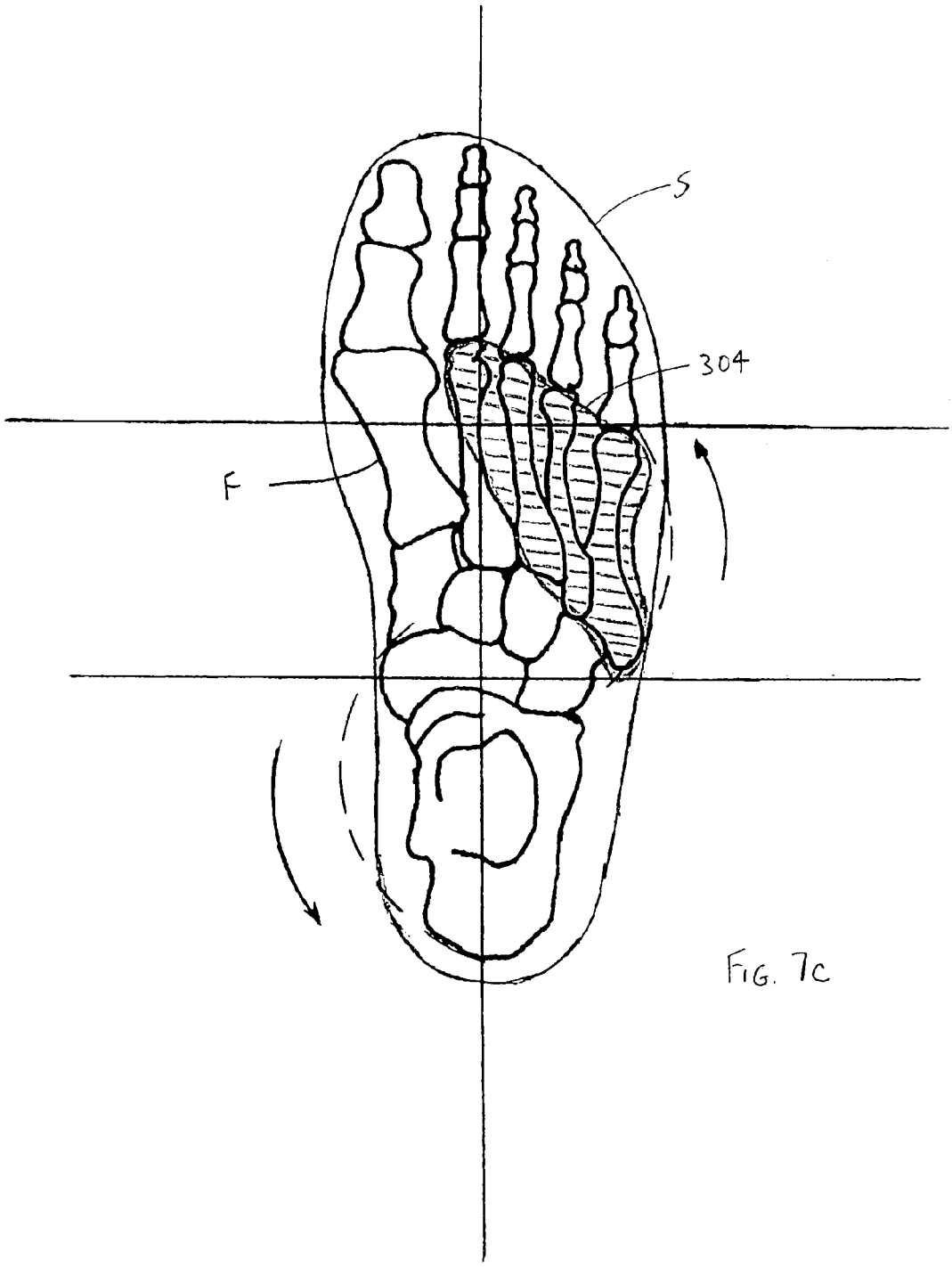
FIG. 7*c* is an illustration of a human foot showing the outline of a sole and a third alternative lateral alignment portion.
Figure 7D:
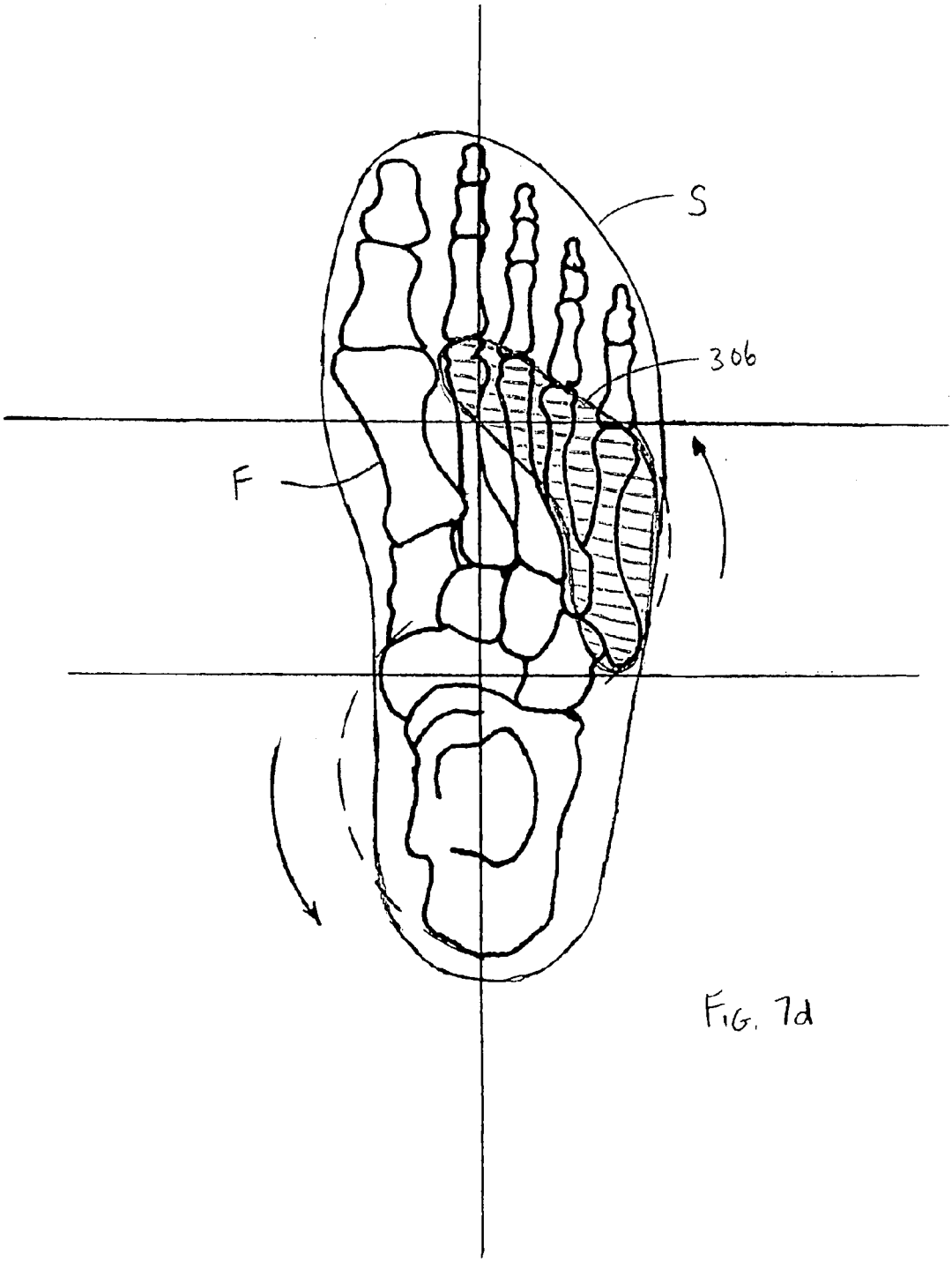
FIG. 7*d* is an illustration of a human foot showing the outline of a sole and a fourth alternative lateral alignment portion.

The rotational impulse is also an important concept to be considered in understanding the natural movement of a woman through her stride. "Rotational impulse" is defined as the directional torque generated by the ground reaction forces that are experienced during foot strike. It is a biomechanical measure of how the body adjusts to changes in the center of gravity to maintain balanced alignment over the foot during movement. Because of the lateral shift in their center of gravity, women will typically exhibit a lateral rotational impulse. Arrows R1 and R2 representing typical rotational impulse in a woman's stride are shown in FIG. 7*a*. A significant number of women will exhibit a lateral rotational impulse trend. One recent study found that 70% of women exhibit a lateral rotational impulse that is significant enough to cause their shoes to prematurely breakdown to the outside and to predispose them to compensatory musculoskeletal injuries.

Biomechanical analysis of foot pressure profiles and rotational impulse patterns of women have made it possible to establish a "functional alignment zone" that can be used to improve the functional design of women's footwear. The present invention has been developed to incorporate this functional alignment zone into a midsole intended specifically for use in women's footwear.

II. Construction

As noted above, the present invention is designed for incorporation into an article of footwear. For purposes of disclosure, the present invention is described in connection with a conventional footwear sole having an outsole 12 for engaging the ground and a midsole 14 for providing the desired cushion and support. The present invention is, however, well-suited for use in essentially any type of sole. The footwear sole 10 may include an insole (not shown), sock liner (not shown) or other intermediate sole member disposed above the midsole 14. The footwear sole 10 is intended to be secured to an upper (not shown) using essentially any attachment construction, including cement, welt and direct attach constructions. The footwear sole 10 may also include a shank or other conventional sole insert, as desired.

Figure 4:
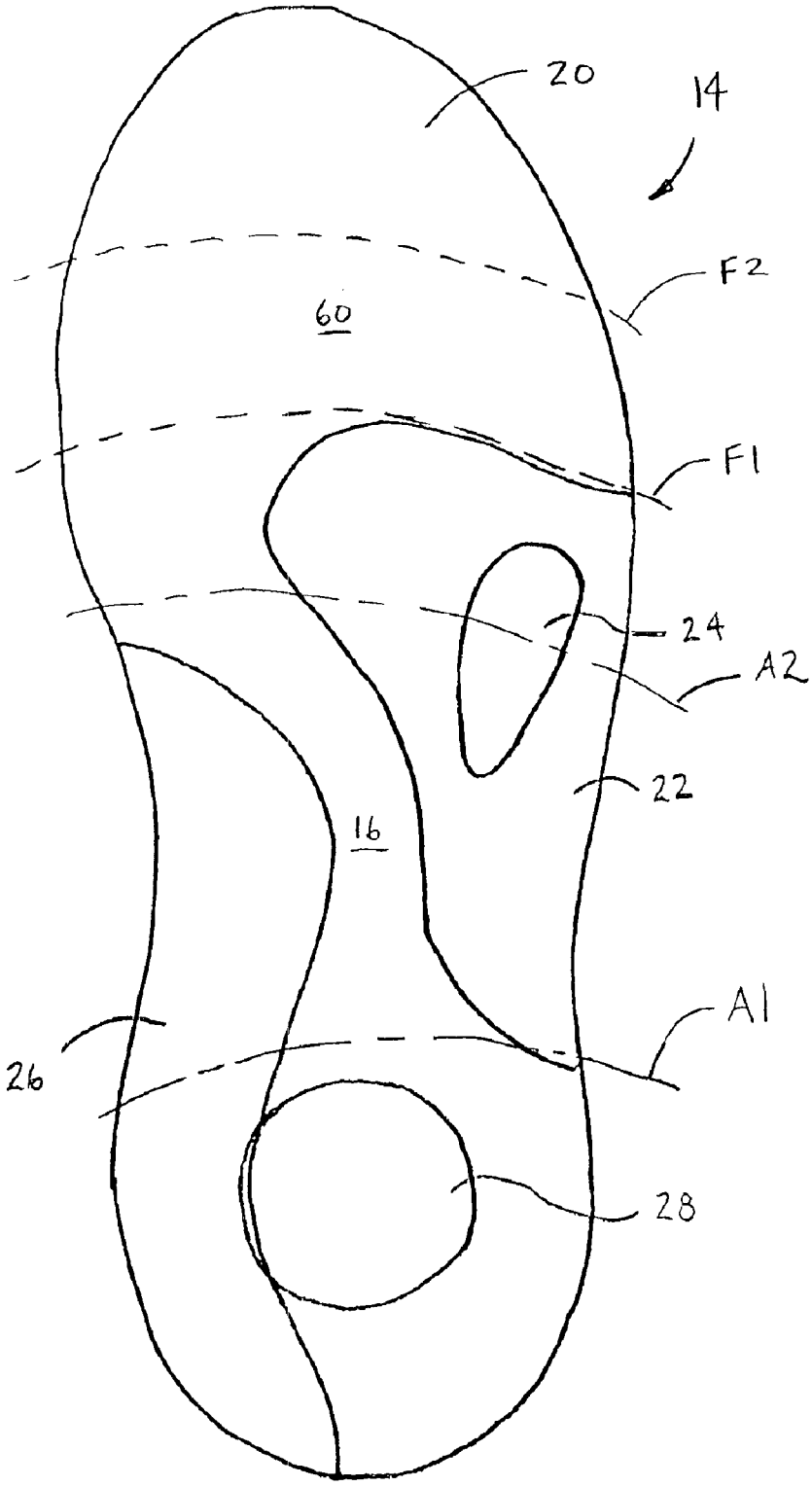
FIG. 4 is a top plan view of the midsole.

To facilitate disclosure of the present invention, reference will be made to various general areas of the foot, such as the heel, arch and forefoot areas, as well as to specific elements of the foot architecture, such as the hallux, metatarsal bones and calcaneus. When used to refer to locations on the midsole, these terms should be interpreted to include those areas of the midsole that are disposed generally (and not necessarily directly) beneath and provide support for the corresponding elements of the foot. For purposes of general reference only, the heel area is generally defined as that area behind (toward the rear of the heel of the sole 10) phantom line A1 (See FIG. 4), the arch area is generally defined as that area between phantom lines A1 and A2 and the forefoot region is generally defined as that area ahead of (toward the tiptoe of the sole 10) phantom line A2. It should be understood, however, that the boundaries between the heel, arch and forefoot areas are not precise and that these terms should be interpreted loosely and with a great deal of flexibility.

The midsole 14 is designed to provide a foot platform that affects the movement pattern of the entire body as a woman moves through her stride. As it is designed to support the foot and to be incorporated into conventional footwear, the midsole 14 is generally foot-shaped. The midsole 14 may, however, take on other shapes, as desired, to accommodate various alternative sole designs. In the illustrated embodiment, the midsole 14 includes a plurality of separate portions that are joined together in a compression molding process to define a continuous support platform. Alternatively, the midsole 14 may include separate and discrete elements that cooperatively support the foot. The midsole 14 includes a generally smooth upper surface 16 designed to support the wearer's foot. The upper surface 16 may include contours, if desired. For example, the upper surface 16 of the midsole 14 may be contoured to match the natural contours of the wearer's foot, for example, by providing the upper surface 16 with a concave heel area, a raised arch area or essentially any other desired shape. The midsole 14 of the illustrated embodiment includes a peripheral lip 18 that extends upwardly around the peripheral edge of the midsole 14. The midsole 14 may directly engage the undersurface of the wearer's foot. In most applications, however, an intermediate or upper sole member (not shown) will be incorporated into the sole 10. For example, an insole (not shown), sock liner (not shown), footbed (not shown) or other sole element may be incorporated into the sole 10 above the midsole 14.

The midsole 14 generally includes a neutral portion 20 that forms the majority of the foot platform. In one embodiment, the neutral portion 20 is manufactured from a compression molded EVA with a compressibility of approximately 55 durometer on the Asker C-scale. The neutral portion 20 may, however, be manufactured from other cushioning materials and using other manufacturing techniques. For example, the neutral portion 20 may be injection molded from polyurethane. In the illustrated embodiment, the neutral portion 20 extends generally through the lateral region of the heel area, the central region of the arch area, the medial region of the forefoot area and throughout essentially the entire toe region. To promote flexibility, the neutral portion 20 preferably extends through the flex zone 60 defined forward of the distal heads of the metatarsals and underlying the proximal phalanges. The flex zone 60 is roughly defined as the region between lines F1 and F2 of FIG. 4.

The midsole 14 also includes a lateral alignment portion 22 that is positioned to address alignment as a woman moves through her stride. More specifically, the lateral alignment portion 22 is generally disposed on the lateral side of the midsole 14. As a woman moves through her stride, there is a natural tendency for her center of mass to migrate in a lateral direction. The lateral alignment portion 22 helps to control this lateral migration by affecting improved alignment from the foot through to the hip. The precise shape of the lateral alignment portion 22 will vary from application to application. In the illustrated embodiment, the lateral alignment portion 22 is configured to extend from the proximal head of the fifth metatarsal to the distal head of the fifth metatarsal and from the distal head of the fifth metatarsal region to the distal head of the second metatarsal. As shown, the lateral alignment portion 22 of this embodiment is somewhat triangular in shape having a greater lateral width in the region of the distal heads of the metatarsals. The lateral alignment portion 22 preferably, but not necessarily, terminates behind the flex zone 60 so that it does not impair the ability of the sole to flex in that region. The flex zone 60 is that portion of the sole ahead of the distal heads of the metatarsals where a majority of the foot flex takes place. As noted above, the flex zone 60 is roughly defined as the region between line F1 and F2 of FIG. 4. Examples of alternatively shaped lateral alignment portions are shown in FIGS. 7*a–d*. In these illustrations, alternatively shaped lateral alignment portions are represented by cross-hatched regions 300, 302, 304 and 306. The illustrations also show the outline of the sole S and the general bone structure of the foot F to provide an understanding of the interrelationship between the foot and the alternative lateral alignment portions 300, 302, 304 and 306. Although not shown, any one of these alternative lateral alignment portions 300, 302, 304 and 306 can be provided with a forefoot fixing portion (as described in more detail below). In the described embodiment, the lateral alignment portion 22 is manufactured from a compression molded EVA with a compressibility of approximately 65 durometer on the Asker C-scale. Like the neutral portion 20, the lateral alignment portion 22 may, however, be manufactured from other cushioning materials and using other manufacturing techniques.

The midsole 14 may also include a forefoot fixing portion 24 disposed within the lateral alignment portion 22. The forefoot fixing portion 24 is configured to extend beneath the distal head of the fifth metatarsal, which is a peak pressure zone for women. The forefoot fixing portion 24 provides less resistance to compression than the lateral alignment portion 22. By positioning it under a peak pressure zone, the forefoot fixing portion 24 not only helps to provide cushioning in a key region, but also to obtain and maintain proper position of the foot on the sole 10. As perhaps best shown in FIG. 4, the forefoot fixing portion 24 of this particular embodiment is somewhat elliptical or "tear-drop" in shape extending not only beneath the distal head of the fifth metatarsal but also beneath a portion of the fifth metatarsal bone, thereby providing a line of increased compressibility under the metatarsal bone and further assisting proper alignment of the foot on the sole 10. In the described embodiment, the forefoot fixing portion 24 is manufactured from a compression molded EVA with a compressibility of approximately 40 durometer on the Asker C-scale. Like the neutral portion 20, the forefoot fixing 24 may be manufactured from other cushioning materials and using other manufacturing techniques.

The midsole 14 of the illustrated embodiment also includes a medial alignment portion 26. The medial alignment portion 26 is intended to facilitate proper alignment during the initial stages of a woman's stride, for example, the period beginning at heel strike and extending until the woman's center of mass has migrated to the lateral side of the sole 10. In the illustrated embodiment, the medial alignment portion 26 extends along the medial side of the sole 10 from the heel area through the arch area. The medial alignment portion 26 of this embodiment does not extend to the distal heads of the metatarsals. In the described embodiment, the medial alignment portion 26 is manufactured from a compression molded EVA with a compressibility of approximately 65 durometer on the Asker C-scale. The medial alignment portion 22 may, however, be manufactured from other cushioning materials and using other manufacturing techniques.

Figure 5B:
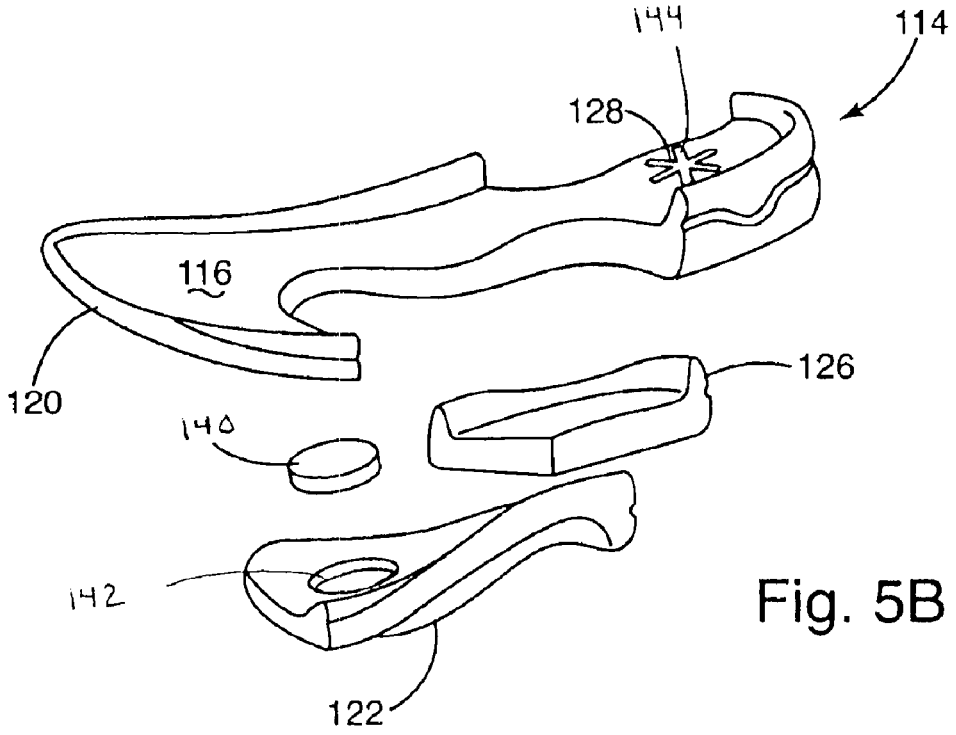
FIG. 5*b* is an exploded perspective view of the midsole of FIG. 5*a;*
Figure 5A:
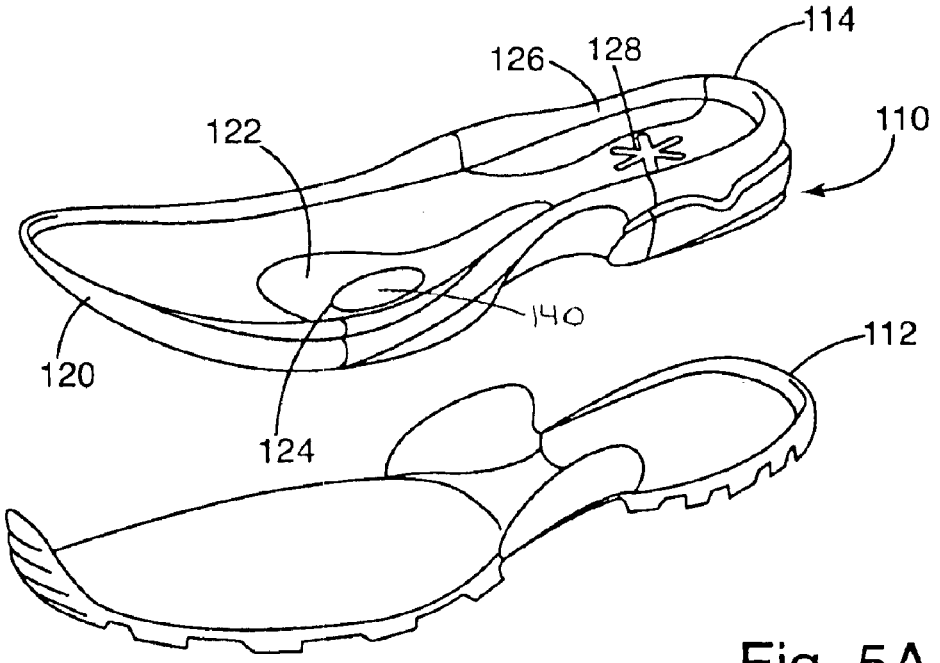
FIG. 5*a* is a partially exploded perspective view of an alternative sole.
Figure 6:
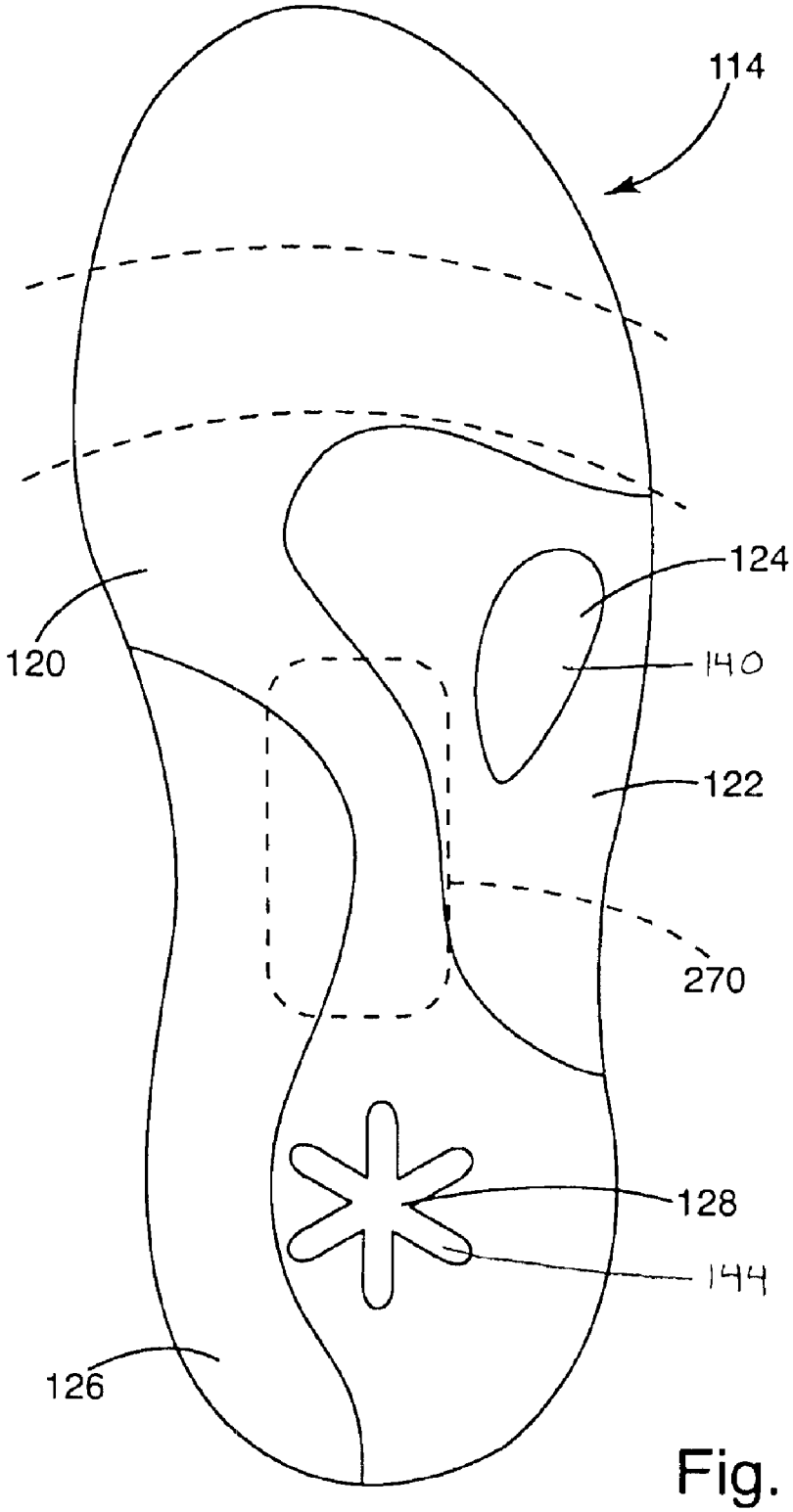
FIG. 6 is a top plan view of the alternative midsole.

In the illustrated embodiment, the midsole 14 also includes a heel fixing portion 28. The heel fixing portion 28 cushions the peak pressure point in the heel and helps to center the foot on the sole 10 during the initial stages of each stride, including during heel strike. In the illustrated embodiment, the heel fixing portion 28 includes a disc-shaped insert 50 that is fitted into a corresponding recess 52 in the heel area. The insert 50 is manufactured from a relatively soft cushioning material, such as a closed cell foam. The size, shape and configuration of the heel fixing portion 28 may vary from application to application. For example, the disc-shaped insert 50 and recess 52 combination may be replaced by one or more perforations that reduce the resistance of the corresponding region to compression. One specific alternative is to replace the disc-shaped insert 50 and recess 52 with a star shaped cutout (See FIGS. 5*a–b* and 6) having its center in approximate alignment with the center of the heel area and points that extend outwardly approximately the same distance as the radius of the disc-shaped insert 50. An alternative embodiment incorporating this alternative construction is described in more detail below. In another alternative, the insert 50 may define a cutout (not shown), for example, a "star-shaped" cutout.

The above description identifies certain approximate durometer values for the various portions of the midsole 14 of the illustrated embodiment. The recited values are merely exemplary and the present invention is not limited to midsole constructions of the specific recited durometer values. To the contrary, the present invention should be broadly interpreted to extend to midsole components having different compressibility values. It should also be noted that the relative differences in the compressibility of the various portions of the midsole may also vary from application to application. For example, the present invention extends to midsoles in which the difference between the compressibility of the neutral portion and the lateral alignment portion varies from the 10 points difference in the above described embodiment.

III. Alternative Embodiments

A sole 110 in accordance with an alternative embodiment of the present invention is shown 5*a–b* and 6. In this embodiment, the sole 110 includes an outsole 112 and a midsole 116 (See FIG. 5*a*). The alternative sole 110 is generally identical to the sole 10 described above, except as specifically described in the following sentences. In this embodiment, the midsole 114 generally includes a neutral portion 120, a lateral alignment portion 122, a forefoot fixing portion 124, a medial alignment portion 126 and a heel fixing portion 128. As with the embodiment described above, the forefoot fixing portion 124, medial alignment portion 126 and heel fixing portion 128 are optional. The forefoot fixing portion 124 includes an insert 140 that is fitted into a corresponding void 142 in the lateral alignment portion 122, rather than extending entirely through the midsole 114 as in the above described embodiment. The insert 140 is manufactured from a material having a substantially lower durometer than the surrounding lateral alignment portion 122. The insert 140 may be secured in the void 142 using conventional adhesive, compression molding or other conventional techniques. The heel fixing portion 128 is defined by a somewhat "star-shaped" cutout 144 formed in the center of the heel area. The cutout 144 may extend entirely or partially through the midsole material depending primarily on the desired compressibility. The size, shape and configuration of the cutout 144 may vary from application to application as desired. The midsole 114 may also include a substantially rigid shank 270 to provide support to the arch area of the sole 110. An exemplary shank 270 is shown in broken lines in FIG. 6. The precise size, shape and configuration of the shank 270 may vary from application to application as desired.

Although described above in connection with midsole constructions having different materials of different durometers, the present invention extends to essentially any midsole construction in which the resistance to compression is varied in accordance with the teachings of the present invention regardless of the way in which varied compression is achieved. In one alternative embodiment, the compressibility of various regions of the sole is controlled by forming perforations in the midsole 214. In this embodiment, the midsole 214 is manufactured from a single continuous mass, for example, by injection molding the midsole 214 from a single polyurethane material or by compression molding the midsole 214 from a single EVA material.

Figure 8:
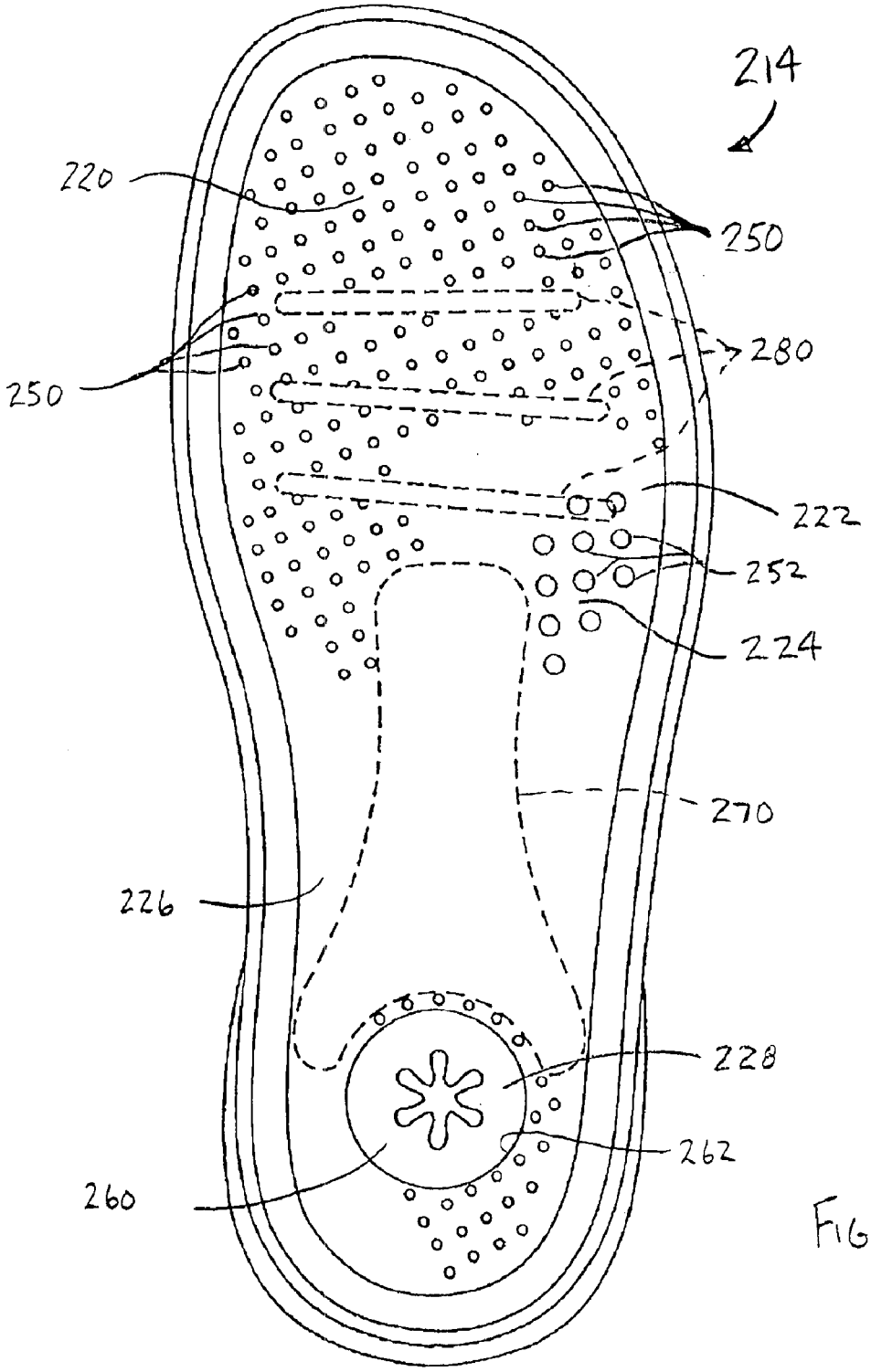
FIG. 8 is a top plan view of another alternative sole in which perforations provide differences in compressibility.

Referring now to FIG. 8, the midsole 214 includes a neutral portion 220 that defines a plurality of perforations 250 in the upper surface of the midsole In this embodiment, the perforations 250 extend to a depth of approximately one-half the thickness of the midsole 214 at that location. The depth of the perforations 250 may vary from application to application. In some applications, the perforations 250 may extend entirely through the midsole 214. The perforations 250 may have essentially any cross-sectional shape, but in the illustrated embodiment are generally circular in cross-section. As shown, the perforations 250 are arranged in a regular pattern throughout a region that is essentially coextensive with the neutral portion 20 of the embodiment described above. The perforations 250 may, however, be arranged in an irregular pattern, with more or less perforations 250 in any given portion of the neutral portion 220. In the illustrated embodiment, the perforations 250 in the neutral portion 220 are of about the same size (e.g. diameter), but the size may vary from perforation to perforation, if desired.

The midsole 214 also includes a lateral alignment portion 222. To provide greater resistance to compression than the neutral portion 220, the lateral alignment portion 222 of this embodiment does not include any perforations 250. The lateral alignment portion 222 could alternatively include perforations that are configured to give the lateral alignment portion 222 greater resistance to compression than the neutral portion 220. For example, the lateral alignment portion 222 may include less perforations, perforations of small size or perforations of lesser depth than the neutral portion 220.

The midsole 214 may also include a forefoot fixing portion 224 disposed within the lateral alignment portion 222. The forefoot fixing portion 224 of the illustrated embodiment is defined by a plurality of perforations 252 disposed within approximately the same location as the forefoot fixing portion 24 of the embodiment described above. That is to say that the forefoot fixing portion 224 is located under the distal head of the fifth metatarsal. In this embodiment, the perforations 252 have a greater diameter than the perforations in the neutral portion 220 to provide less resistance to compression than either the lateral alignment portion 222 or the neutral portion 220. Alternatively or in addition, the perforations 252 may be placed closer together, have a greater depth or a different cross sectional shape so that the forefoot fixing portion 224 provides the desired resistance to compression. The precise size, shape and configuration of the perforations 252 may vary from application to application.

The alternative midsole 214 may further include a medial alignment portion 226. Like the lateral alignment portion 222, the medial alignment portion 226 does not include any perforations 250 so that it provides greater resistance to compression than the neutral portion 220. The medial alignment portion 226 could alternatively include perforations that are configured to give the medial alignment portion 226 greater resistance to compression than the neutral portion 220. For example, the medial alignment portion 226 may include less perforations, perforations of small size or perforations of lesser depth than the neutral portion 220.

The alternative midsole 214 may also include a heel fixing portion 228. As with the embodiment described above, the heel fixing portion 228 cushions the peak pressure point in the heel and helps to center the foot on the sole 210 during the initial stages of each stride. In the illustrated embodiment, the heel fixing portion 228 includes a disc-shaped insert 260 that is fitted into a corresponding recess 262 in the heel area. The disc-shaped insert 260 may define a somewhat star-shaped cutout 264. The size, shape and configuration of the heel fixing portion 228 may vary from application to application. For example, the disc-shaped insert 260 may be replaced by one or more perforations that reduce the resistance of the central heel region. One specific alternative is to eliminate the disc-shaped insert 260 and to replace it with a somewhat "star-shaped" cutout (See, for example, FIG. 6) directly in the midsole material.

In this alternative embodiment, the sole 210 is intended to function with a shank that is disposed above the midsole 114. Although the shank is not shown, the general outline of a shank 270 is shown in FIG. 8 in broken lines. As can be seen, the shank 270 extends through the arch area of the sole 210. Because of the rigidity of the shank 270, the portion of the midsole 214 underlying the shank 270 is not perforated in this embodiment. Although it is permissible to perforate the midsole 214 in the region of the shank 270, the shank's stiffness dramatically reduces the impact of any such perforations. The shank is not necessary and, if included, may be incorporated into the midsole 114 in different ways. For example, the shank (not shown) may be secured to the undersurface of the midsole 214 or embedded within the midsole 214. In these alternative embodiments, perforations may or may not be formed in the shank region depending on the desired characteristics of the midsole 114.

The midsole 214 may further define one or more flex grooves 280 intended to improve the flexibility of the sole 210. As shown in FIG. 8, the midsole 214 may define three laterally extending flex grooves 280. In this embodiment, the grooves 280 have a depth of approximately 3.5 millimeters and extend in a line across a majority of the sole width. The size, shape, number and position of the flex grooves may vary from application to application as desired. Flex grooves may be incorporated into any of the embodiments described herein.

The alternative midsole 214 is intended to be incorporated into an otherwise conventional sole 210. The sole 210 preferably includes an outsole (not shown) disposed below the midsole 214. A footbed (not shown) disposed above the midsole 214. The outsole and footbed may be secured to the midsole 214 by adhesive or other conventional methods. The upper (not shown) can be secured to the sole 210 using essentially any conventional techniques and apparatus.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A midsole for an article of footwear comprising:

a forefoot area having a lateral region and a medial region;

a neutral portion extending through at least said medial region of said forefoot area; and a lateral alignment portion disposed in at least said lateral region of said forefoot area, said lateral alignment portion extending from an area substantially beneath a proximal head of a fifth metatarsal of a wearer's foot to an area substantially beneath a distal head of a fifth metatarsal of a wearer's foot to an area substantially beneath a distal head of a third metatarsal of a wearer's foot, said lateral alignment portion having a medial edge, all of said medial edge bordered by said neutral portion, said lateral alignment portion having a greater resistance to compression than said neutral portion.

2. The midsole of claim 1 further comprising an arch area having a central region and a heel area having a medial region and a lateral region, said neutral portion extending at least through said central region of said arch area and said lateral region of said heel area.

3. The midsole of claim 2 further including a flex line extending laterally across the midsole and defined by a natural flex line of wearer's foot; and wherein said lateral alignment portion does not extend into said flex line.

4. The midsole of claim 3 further including a heel fixing portion disposed substantially in a center of said heel area, said heel fixing portion providing less resistance to compression than said neutral portion.

5. The midsole of claim 2 wherein said neutral portion is manufactured from a first material and said lateral alignment portion is manufactured from a second material, said first material having a durometer that is substantially less than a durometer of said second material.

6. The midsole of claim 5 wherein said medial alignment portion is manufactured from a third material, said first material having a durometer that is substantially less than a durometer of said third material.

7. The midsole of claim 5 wherein said forefoot fixing portion is manufactured from a fourth material, said fourth material having a durometer that is substantially less than a durometer of said first material.

8. The midsole of claim 2 wherein said neutral portion defines a plurality of perforations providing said neutral portion with less resistance to compression than said lateral alignment portion.

9. The midsole of claim 1 further comprising a forefoot fixing portion disposed substantially beneath a distal head of a fifth metatarsal of a wearer's foot, said forefoot fixing portion disposed within said lateral alignment portion and not extending to a lateral edge of said forefoot area, said forefoot fixing portion providing lesser resistance to compression than said lateral alignment portion.

10. The midsole of claim 9 wherein said forefoot fixing portion provides lesser resistance to compression than said neutral portion.

11. The midsole of claim 9 further comprising a medial alignment portion extending substantially from said medial region of said heel area through said medial region of said arch area, said medial alignment portion providing greater resistance to compression than said neutral portion.

12. The midsole of claim 11 wherein said medial alignment portion and said lateral alignment portion provide substantially equal resistance to compression.

13. The midsole of claim 11 wherein said neutral portion has a durometer value of approximately 55 on the Asker C-Scale, said lateral alignment portion has a durometer value of approximately 65 on the Asker C-Scale, said medial alignment portion has a durometer value of approximately 65 on the Asker C-Scale, and said forefoot fixing portion has a durometer value of approximately 40 on the Asker C-Scale.

14. The midsole of claim 9 wherein said neutral portion defines a plurality of perforations providing said neutral portion with less resistance to compression than said lateral alignment portion; and wherein said forefoot fixing portion defines one or more perforations providing said forefoot fixing portion with less resistance to compression than said lateral alignment portion and said neutral portion.

15. A component for a footwear sole having a heel area, an arch area and a forefoot area, the component comprising:

a neutral portion having a first resistance to compression, said neutral portion extending at least through a medial portion of the forefoot area, a lateral portion of said heel area, and a central region of said arch area; and a lateral alignment portion having a second resistance to compression, said second resistance being greater than said first resistance, said lateral alignment portion extending at least through a lateral portion of the forefoot area, and at least from a point substantially beneath a distal head of a third metatarsal to a point substantially beyond a distal head of a fifth metatarsal head, and further extending to a point substantially beneath a proximal head of said fifth metatarsal head.

16. The component of claim 15 wherein the component includes a flex zone extending through a portion of said forefoot area forward of the distal heads of the metatarsals, said lateral alignment portion not extending into said flex zone.

17. The component of claim 15 wherein said neutral portion extends at least through substantially all of said flex zone.

18. The component of claim 15 further comprising a forefoot fixing portion extending at least beneath said distal head of said fifth metatarsal, said forefoot fixing portion spaced away from a lateral edge of said component, said forefoot fixing portion having a third resistance to compression, said third resistance being substantially lesser than said second resistance.

19. The component of claim 18 wherein said forefoot fixing portion extends at least partially beneath said fifth metatarsal.

20. The component of claim 18 further comprising a medial alignment portion extending at least along a medial portion of said heel area and a medial portion of said arch area, said medial alignment portion having a fourth resistance to compression, said fourth resistance being substantially greater than said first resistance.

21. The component of claim 18 wherein each of said neutral portion, said lateral alignment portion and said forefoot fixing portion are compression molded from materials of different durometer values.

22. A sole component for an article of footwear having a heel area, an arch area and a forefoot area, the midsole comprising:

a neutral portion having a first resistance to compression, said neutral portion extending at least through said forefoot area and said arch area;

a lateral alignment portion having a second resistance to compression, said second resistance being greater than said first resistance, said lateral alignment portion extending at least through a lateral portion of the forefoot area from an area substantially beneath a proximal head of a fifth metatarsal of a wearer's foot to an area substantially beneath a distal head of a fifth metatarsal of a wearer's foot to an area substantially beneath a distal head of a second metatarsal of a wearer's foot; and a forefoot fixing portion within said lateral alignment portion, said forefoot fixing portion extending at least beneath said distal head of said fifth metatarsal, said forefoot fixing portion spaced away from a lateral edge of said midsole, said forefoot fixing portion having a third resistance to compression, said third resistance being substantially lesser than said second resistance.

23. The sole component of claim 22 wherein said lateral alignment portion extends to a lateral edge of the sole component from a first location approximately in line with the distal metatarsal heads of a wearer's foot to a second location approximately in line with the proximal metatarsal heads of a wearer's foot.

* * * * *